US010968670B2

(12) United States Patent
Kruedener et al.

(10) Patent No.: US 10,968,670 B2
(45) Date of Patent: Apr. 6, 2021

(54) ARTICULATED LEVER FOR A DEVICE FOR MOVING A FURNITURE PART RECEIVED ON A FURNITURE CARCASS OF AN ITEM OF FURNITURE

(71) Applicant: Grass GmbH, Reinheim (DE)

(72) Inventors: Boris Kruedener, Kleinostheim (DE); Markus Herper, Mühltal (DE)

(73) Assignee: Grass GmbH, Reinheim (DE)

( * ) Notice: Subject to any disclaimer, the term of this patent is extended or adjusted under 35 U.S.C. 154(b) by 99 days.

(21) Appl. No.: 16/381,345

(22) Filed: Apr. 11, 2019

(65) Prior Publication Data

US 2019/0316395 A1 Oct. 17, 2019

(30) Foreign Application Priority Data

Apr. 17, 2018 (DE) ..... 20 2018 102 086.2

(51) Int. Cl.
*E05D 3/16* (2006.01)

(52) U.S. Cl.
CPC ..... *E05D 3/16* (2013.01); *E05D 2003/163* (2013.01); *E05D 2700/12* (2013.01); *E05Y 2900/20* (2013.01)

(58) Field of Classification Search
CPC .... E05D 3/16; E05D 2700/12; E05Y 2900/20
See application file for complete search history.

(56) References Cited

U.S. PATENT DOCUMENTS 2,122,034 A * 6/1938 Jackle ..... E05D 3/186 16/358
4,322,112 A * 3/1982 Berghaus ..... B60N 2/2252 297/354.12

(Continued)

FOREIGN PATENT DOCUMENTS

DE 200 03 289 U1 8/2001
EP 0 158 604 A2 10/1985

(Continued)

OTHER PUBLICATIONS

Extended European Search Report (Application No. 19168329.1) dated Oct. 4, 2019.

(Continued)

*Primary Examiner* — Victor D Batson
*Assistant Examiner* — Matthew J Sullivan
(74) *Attorney, Agent, or Firm* — Burr & Brown, PLLC

(57) ABSTRACT

An articulated lever for a device for moving a furniture part received on a furniture carcass of an item of furniture, which has a spacer member in the form of a first and a second embossing. The first embossing is present on a first side of the first articulated lever, and the second embossing is present on a second side of the first articulated lever. The first and the second side of the first articulated lever are present opposite and spaced from one another. The first and the second embossing are present opposite one another. The first embossing has in the azimuthal and/or radial direction, about a center, an elevation and a depression relative to a remaining surface of the first side. The second embossing has in the azimuthal and/or radial direction, about the center, an elevation and a depression relative to a remaining surface of the second side.

13 Claims, 5 Drawing Sheets

(56) References Cited

U.S. PATENT DOCUMENTS

| | | | | |
|---|---|---|---|---|
| 5,195,215 | A * | 3/1993 | Kiefer | E05D 5/062 16/223 |
| 6,014,806 | A * | 1/2000 | Ohya | B60N 2/236 29/893.33 |
| 6,061,870 | A * | 5/2000 | Dodge | A63C 10/04 16/2.1 |
| 6,892,784 | B2 * | 5/2005 | Maas | A47G 5/00 16/319 |
| 7,189,468 | B2 * | 3/2007 | Izenson | H01M 8/0206 429/444 |
| 8,683,774 | B2 * | 4/2014 | Strickland | E04C 5/03 52/742.14 |
| 9,936,624 | B2 * | 4/2018 | Nininger | A01B 73/00 |
| 9,944,116 | B1 * | 4/2018 | Roberts | B60B 7/068 |
| 9,963,291 | B2 * | 5/2018 | Karles | B65D 1/36 |
| 2016/0025165 | A1 * | 1/2016 | Plantan | B60B 27/0052 188/218 XL |
| 2018/0179845 | A1 * | 6/2018 | Pallin | E21B 10/32 |

FOREIGN PATENT DOCUMENTS

| | | |
|---|---|---|
| GB | 2 092 220 A | 8/1982 |
| GB | 2 335 702 A | 9/1999 |

OTHER PUBLICATIONS

German Search Report (Application No. 20 2018 102 086.2) dated Mar. 14, 2019.

* cited by examiner

SECTION A-A

ARTICULATED LEVER FOR A DEVICE FOR MOVING A FURNITURE PART RECEIVED ON A FURNITURE CARCASS OF AN ITEM OF FURNITURE

This application claims the benefit under 35 USC § 119(a)-(d) of German Application No. 20 2018 102 086.2 filed Apr. 17, 2018, the entirety of which is incorporated herein by reference.

FIELD OF THE INVENTION

The present invention relates to an articulated lever for a device for moving a furniture part received on a furniture carcass of an item of furniture.

BACKGROUND OF THE INVENTION

Guides such as furniture hinges or flap fittings are known in the furniture sector in order to be able to move a furniture part relative to a furniture carcass.

The guide must meet different requirements; in particular, an interior of the furniture carcass or of the movable furniture part should be made accessible by means of the movement guide in order to be able to accommodate objects therein or remove them therefrom.

A disadvantage with known guides is that they are of comparatively multipart design and comparatively cost-intensive to produce.

SUMMARY OF THE INVENTION

It is an object of the present invention to improve an articulated lever for a device for moving a furniture part received on a furniture carcass of an item of furniture, with the result that it and, in particular, the device, can be produced in a comparatively cost-effective manner, and the device has, in particular, comparatively few individual parts.

The present invention is based on an articulated lever for a device for moving a furniture part received on a furniture carcass of an item of furniture.

The essence of the present invention is seen in the fact that the articulated lever has a spacer member in the form of a first and a second embossing, wherein the first embossing is present on a first side of the first articulated lever, and the second embossing is present on a second side of the first articulated lever, wherein the first and the second side of the first articulated lever are present opposite one another and spaced apart from one another, wherein the first and the second embossing are present opposite one another, wherein the first embossing has in the azimuthal and/or radial direction, about a center, an elevation and a depression relative to a remaining surface of the first side, and the second embossing has in the azimuthal and/or radial direction, about a center, in particular about the center, an elevation and a depression relative to a remaining surface of the second side.

An embossing is to be understood, for example, as meaning a formation of a surface region of the articulated lever, wherein the formation of the surface region is advantageously produced by an embossing method. The embossing forms, for example, a surface structure of the articulated lever. For example, the first and the second embossing can be produced by an, in particular single, embossing method, for example an, in particular single, embossing step. For example, the first embossing is predetermined by the shape of an embossing punch, and the second embossing is predetermined by the shape of an embossing die. It is also conceivable that the first embossing and the second embossing are produced solely by the shape of an embossing punch or an embossing die, in which case the first embossing is advantageously produced in a first production step and the second embossing in a further production step. The articulated lever is advantageously present in one piece with the embossing.

The device preferably takes the form of a hinge or a fitting, in particular, an upper flap fitting.

It has also proved advantageous for the first and/or the second embossing to comprise a plurality of elevations and/or a plurality of depressions and for these elevations and depressions to be formed in an alternating manner. The embossing is present, for example, in a wave-like manner. For example, an elevation and/or a depression are or is designed to be ring-like or wave-like. In particular, the ring-like or wave-like elevations and the ring-like or wave-like depressions are present concentrically, in particular, concentrically about a center.

The embossing can also be present in a star-shaped, sunbeam-like and/or fan wheel-like manner. The elevations and depressions are present, for example, in a circular segment-shaped or circular portion-like manner. Advantageously, the circular segment-shaped or circular portion-like elevations and/or the circular segment-shaped or circular portion-like depressions are arranged concentrically, for example being present concentrically about the center.

The elevations and depressions of the first and the second embossing are advantageously designed to extend concentrically about a common center.

Moreover, it is advantageous that the articulated lever has an attachment member in the form of a through-opening which extends starting from the first side of the articulated lever to the opposite second side of the articulated lever, and wherein the first and/or the second embossing are or is designed to extend about the opening, in particular, at a surface region of the articulated lever about the opening. The attachment member is present, for example, as a bore and/or as a bolt, by means of which the articulated lever can be connected, for example, pivotably, to a further element. The first and the second embossing of the articulated lever are preferably present in a region about the attachment member on the articulated lever. The first and the second embossing are advantageously present so as to extend in a circular manner about the attachment member, in particular, the opening. The opening is, for example, designed to be cylindrical. For example, the first and/or the second embossing occupy or occupies a circular or an annular region, in particular, an areal region, on a surface of the articulated lever.

Furthermore, it is proposed that the articulated lever has two, three or more spacer members which are formed on the articulated lever so as to be spaced apart from one another. The articulated lever advantageously comprises precisely one spacer member, precisely two spacer members or precisely three spacer members. For example, precisely two or precisely three openings are present on the articulated lever. In each case, a first and, in particular, in each case a second embossing advantageously extend around an opening.

In one advantageous embodiment of the articulated lever, the first embossing and/or the second embossing have or has a bearing surface.

The bearing surface is advantageously formed in such a way that a further element, for example, a further articulated lever, of the device can be arranged, in particular, to bear flat against the bearing surface. The first embossing and/or the second embossing advantageously comprise or comprises a plurality of, in particular, three, bearing surfaces for, in particular, flat bearing of the further element, with the result that the first and/or second embossing form or forms, for example, a three-point bearing support for the further element.

It is also advantageous that the elevation of the first embossing and/or the elevation of the second embossing have or has, in particular, form or forms, a bearing surface.

Also proposed is a device for moving a furniture part received on a furniture carcass of an item of furniture, wherein the device has a guide, wherein, with the device mounted on the item of furniture, the furniture part can be moved from a closed position relative to the furniture carcass into an open position relative to the furniture carcass and back by way of the guide, wherein, in the closed position, the furniture part assumes a position in which it is moved up to a front side of the furniture carcass, wherein one guide is formed as a first articulated lever, and a further guide is formed as a second articulated lever, wherein the second articulated lever is formed in a sandwich-like manner with at least two lever arms, with the result that the first articulated lever is received so as to be movable between the two lever arms of the second articulated lever, wherein the first and the second articulated lever are articulately connected to one another at an attachment region by an attachment member, wherein the first articulated lever is formed as an articulated lever according to one of the aforementioned designs, and wherein the embossings, in particular, the first and the second embossing of the first articulated lever, are arranged between the lever arms of the second articulated lever. As a result, mounting of the device is simplified.

The first articulated lever advantageously has an embossing at the attachment region, with the result that a remaining surface of the first side of the first articulated lever and/or a remaining surface of the second side of the first articulated lever in the arranged state on the second articulated lever are or is present spaced apart from a side of the second articulated lever, in particular, spaced apart from a side of a lever arm of the second articulated lever, by means of the first and/or second embossing. A lever arm of the second articulated lever preferably bears against a bearing surface of an embossing of the first articulated lever. An embossing advantageously has a function of a spacer disk or of a spacer element.

The first and the second articulated lever are connected to one another, in particular, pivotably. The first and the second articulated lever are advantageously movable relative to one another about a pivot axis. The elevation of the first embossing is preferably present in the direction of the pivot axis oppositely to the depression of the second embossing.

Moreover, it is advantageous that the device comprises a rivet member, wherein the rivet member has a cylinder shape which has a larger diameter in a central region than a further diameter in a region of a first end of the rivet member and than a further diameter in a region of a second end of the rivet member. As a result, mounting of the device is facilitated.

For example, the central region of the rivet member is designed to be cylindrical. For example, the first end and the second end of the rivet member are designed to be cylindrical. It is conceivable that a diameter of the cylindrical first end of the rivet member is at least approximately identical to a diameter of the cylindrical second end of the rivet member.

For example, the rivet member consists of three cylinder elements which are formed in one piece with one another, bearing against one another at end faces of the cylinder elements, wherein two cylinder elements have a smaller diameter than a third cylinder element. The third cylinder element advantageously forms the central region of the rivet member. The central region preferably extends along a cylinder axis of the third cylinder element, in particular, completely over a length of the third cylinder element. The bearing member is advantageously part of an end face of the third cylinder element.

It also proves to be advantageous for the rivet member to be formed as a solid rivet. The rivet member is formed, for example, from a solid material and advantageously does not have a cavity.

It is additionally proposed that the rivet member is present in such a way that, in the arranged state of the rivet member on the device, in particular, on the opening of the first articulated lever, the rivet member engages through the opening and has its central region arranged in the region of the opening, wherein the rivet member extends by the first end beyond the first side of the first articulated lever and by the second end beyond the second side of the first articulated lever, wherein the central region of the rivet member is longer along a cylinder axis of the rivet member than a width of the first articulated lever, wherein the width extends, in particular, at least from the remaining surface of the first side to the remaining surface of the second side of the first articulated lever, with the result that an end face of the central region forms a bearing member for the second articulated lever. For example, the width of the first articulated lever extends from a bearing surface of the first embossing of the first articulated lever to a bearing surface of the second embossing of the first articulated lever.

A length of the central region of the rivet member is advantageously approximately identical, in particular, exactly identical, to a width of the first articulated lever, wherein the width of the first articulated lever extends from a bearing surface of the first embossing of the first articulated lever to a bearing surface of the second embossing of the first articulated lever.

The central region of the rivet member is advantageously designed to be offset or stepped in relation to the remaining regions of the rivet member.

The bearing member is present as a bearing surface, for example. The bearing member is designed, for example, to be annular, for example as a circular ring surface.

The rivet member is advantageously present in such a way that the central region of the rivet member extends along a cylinder axis of the rivet member in the arranged state from a bearing surface of an elevation of the first embossing to a bearing surface of an elevation of the second embossing.

The central region of the rivet member advantageously extends from a first bearing member to a further bearing member of the rivet member, wherein the first bearing member is advantageously present in the region of the first end of the rivet member, and the second bearing member is present in the region of the second end of the rivet member.

Additionally proposed is an item of furniture having an articulated lever according to one of the aforementioned variants and/or having a device according to one of the aforementioned embodiments.

BRIEF DESCRIPTION OF THE DRAWINGS

Further features and advantages of the present invention are explained in more detail with reference to the exemplary embodiments schematically illustrated in the figures, in which specifically.

DETAILED DESCRIPTION OF THE INVENTION

Figure 1:
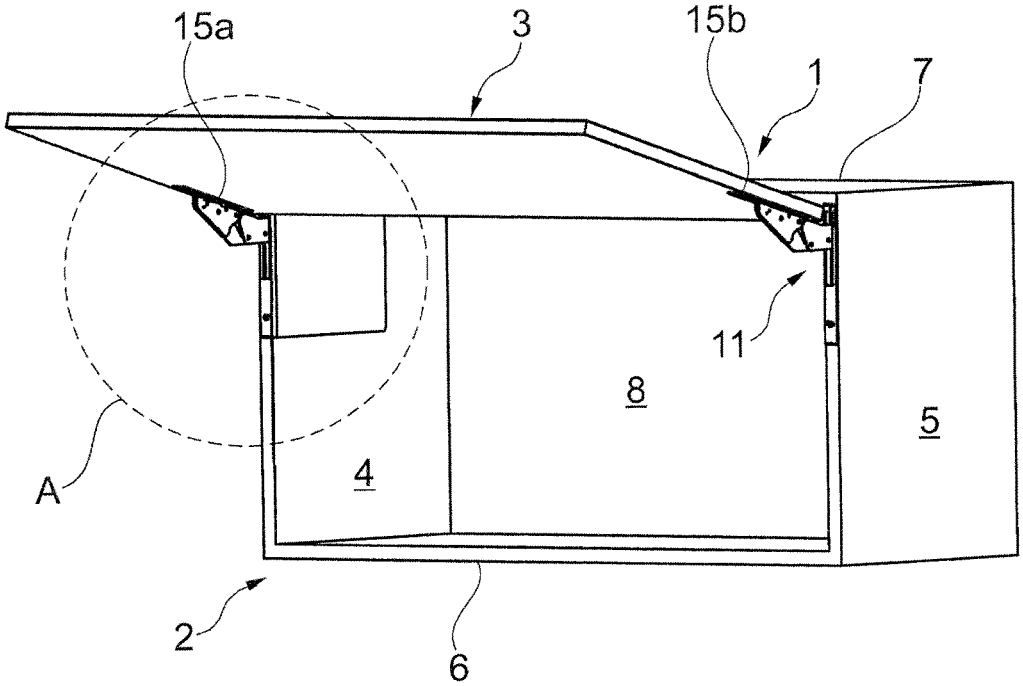
FIG. 1 shows a perspective view of an item of furniture according to the present invention having a device according to the present invention for moving a furniture part illustrated as opened.
Figure 2:
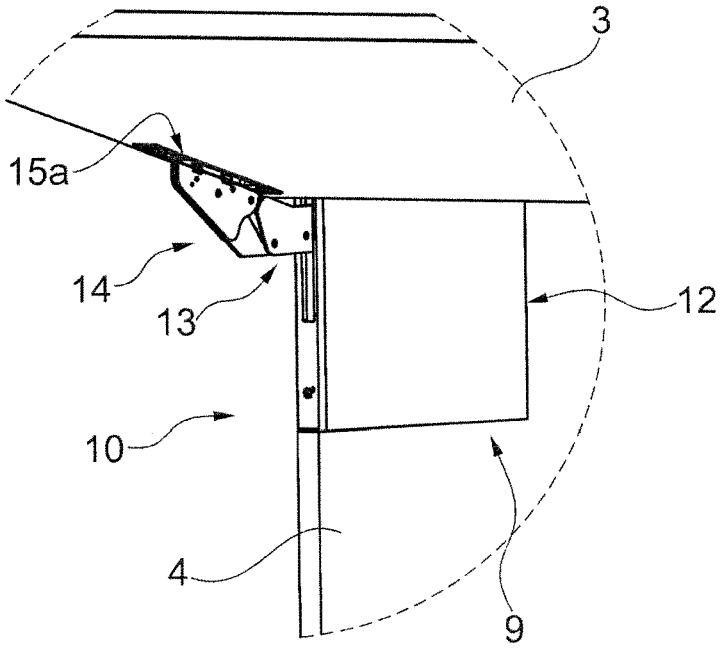
FIG. 2 shows the region A encircled in FIG. 1 in an enlarged illustration.

FIG. 1 shows in perspective an item of furniture according to the present invention, or a wall unit 1 having a box-shaped furniture carcass 2 and a furniture part received thereon which takes the form of a panel-like upper flap 3 which is shown in an open position relative to the furniture carcass 2.

The furniture carcass 2 comprises two opposite, upright side walls 4 and 5 which are connected at the bottom to an underside 6 and at the top to an upper side 7. The furniture carcass 2 is closed on the rear side by a rear wall 8.

To move the upper flap 3 about a horizontal pivot axis relative to the furniture carcass 2 from the open position shown in FIG. 1 into a closed position (not shown) in which it is moved up on the front side to the furniture carcass 2, a movement device according to the present invention is present which is configured as an upper flap fitting 9. The upper flap fitting 9 has a first fitting unit 10 on the side wall 4 and a second fitting unit 11 on the side wall 5, the fitting units being constructed identically but, for functionally correct arrangement on the respective side wall 4 or 5, in a side-relevant manner.

Each fitting unit 10 and 11 comprises a base unit 12, guide 13 having articulated levers, and a mounting unit in the form of a mounting plate 15*a*, 15*b*. A plurality of articulately mounted articulated levers which are present as pivot or lever arms of a pivot arm arrangement 14 serve to connect the base unit 12 to the mounting plate 15*a*, 15*b*, which is fastened securely to an inner side of the upper flap 3, for example, so as to be sunk in a material recess.

Figure 3:
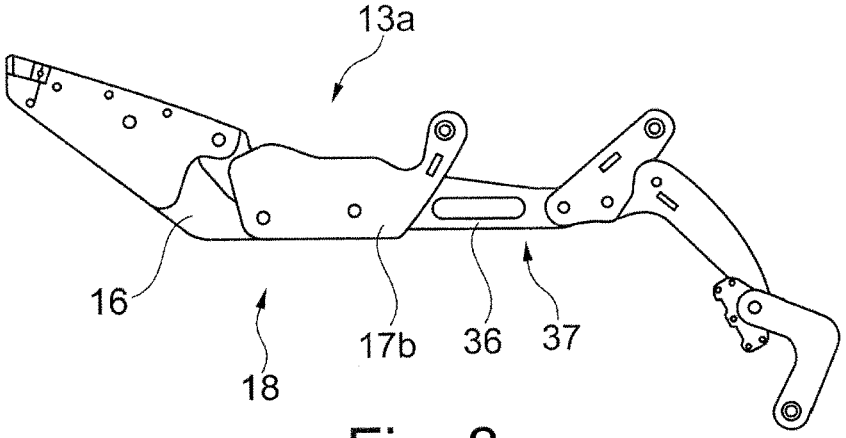
FIG. 3 shows a side view of the guide of the device.
Figure 4:
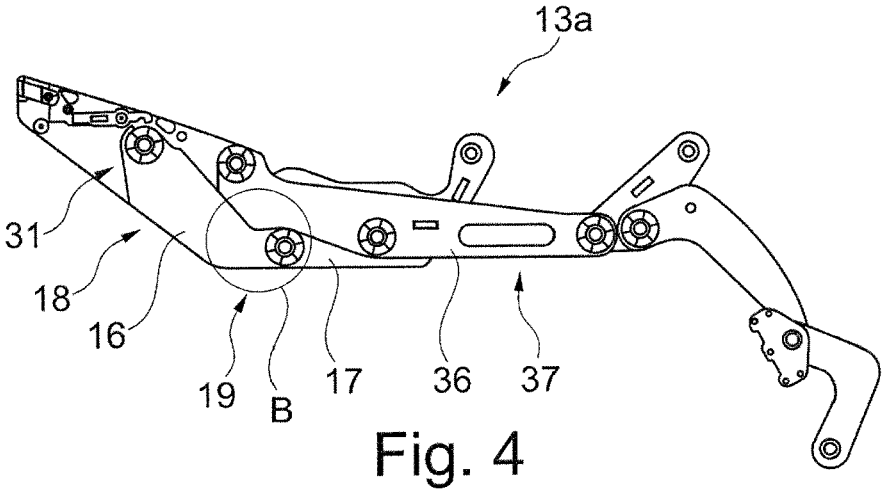
FIG. 4 shows a side view of the guide from FIG. 3, parts of the guide being illustrated in phantom.

FIGS. 3 and 4 illustrate a side view of the guide 13*a* in a first design variant, FIG. 4 showing parts of the guide 13*a* in phantom.

Figure 5:
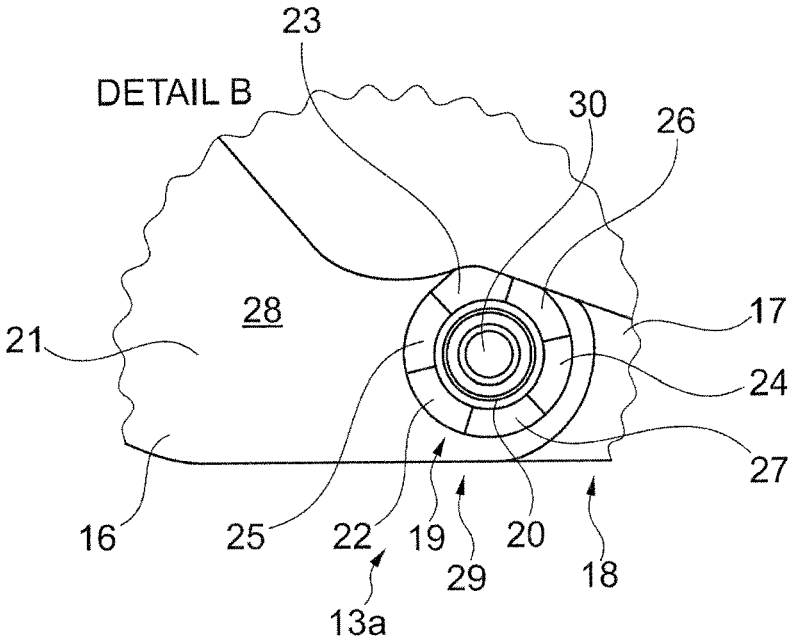
FIG. 5 shows a detail view B of the guide according to FIG. 4.
Figure 6:
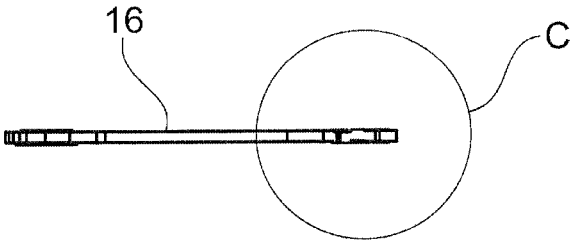
FIG. 6 shows a plan view of an articulated lever according to the present invention.

FIG. 5 illustrates a detail view B of the guide 13*a*. An articulated lever 16 and a lever arm 17*a* of a further articulated lever 18 formed in a sandwich-like manner are shown in FIG. 5. The articulated lever 18 comprises two lever arms 17*a*, 17*b*. The articulated lever 16 comprises a single lever arm and is present in the arranged state between the lever arms 17*a*, 17*b* of the articulated lever 18. An attachment member in the form of an opening 20 is formed on the articulated lever 16 at an attachment region 19. Extending around the opening 20 on a first side 21 of the articulated lever 16 in the radial direction is a first embossing 29 in the form of elevations 22 to 24 and depressions 25 to 27. The elevations 22-24 and depressions 25-27 are advantageously present in a circular segment-like manner. The elevations 22-24 and depressions 25-27 are advantageously designed to be offset in the image plane with respect to a remaining surface 28 of the first side 21. A rivet member 30 is additionally shown in the opening 20. The articulated lever 16 advantageously comprises two attachment regions 19, 31.

Figure 7:
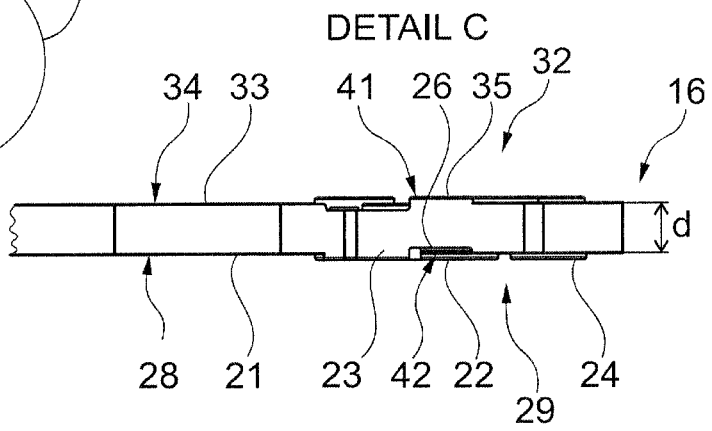
FIG. 7 shows a detail view of a detail C of the articulated lever according to FIG. 6.
Figure 8:
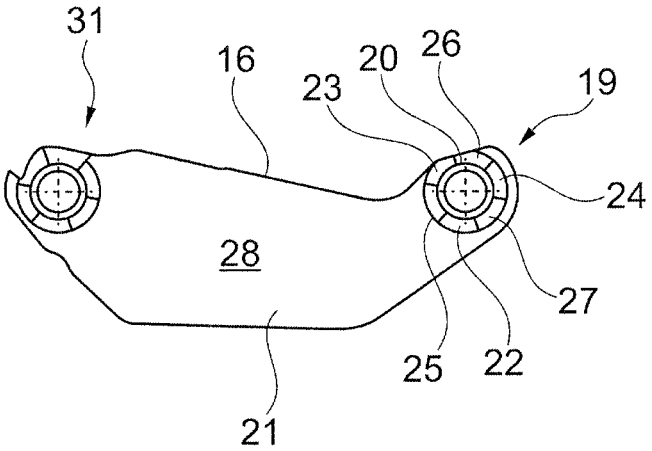
FIG. 8 shows a side view of the articulated lever according to FIG. 6.

The first embossing 29 and a second embossing 32 are shown in the detail view C (FIG. 7) of the articulated lever 16. The embossing 32 is situated at the attachment region 19 on a second side 33 opposite to the first embossing 29, parts of the second embossing 32 being designed to be raised or sunk with respect to a remaining surface 34 of the second side 33 of the articulated lever 16. A depression 26 of the first embossing 29 is advantageously designed to be opposite to an elevation 35 of the second embossing 32. A thickness or width d of the articulated lever 16 is advantageously formed by a spacing of the remaining surface 28 of the first side 21 from the remaining surface 34 of the second side 33 of the articulated lever 16. A spacing of a surface 41 of the elevation 35 of the second embossing 32 from a surface 42 of the depression 26 of the first embossing 29, or vice versa, is advantageously equal to the width d of the articulated lever 16.

Figure 9:
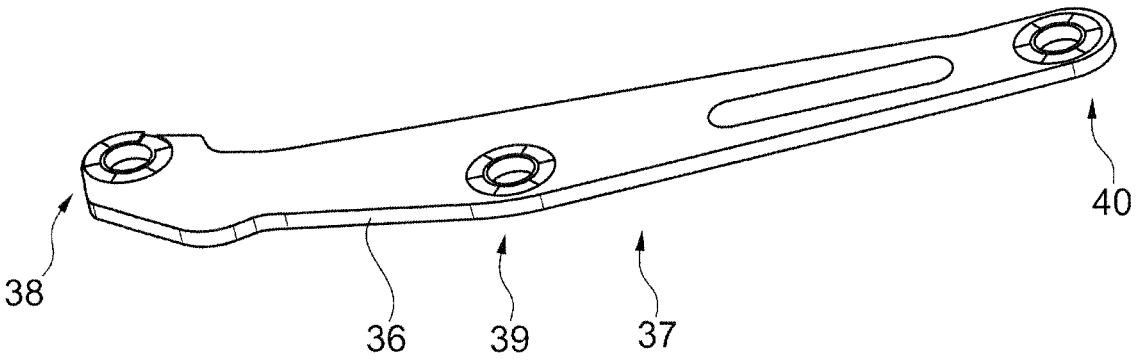
FIG. 9 shows a perspective view of a further articulated lever.
Figure 10:
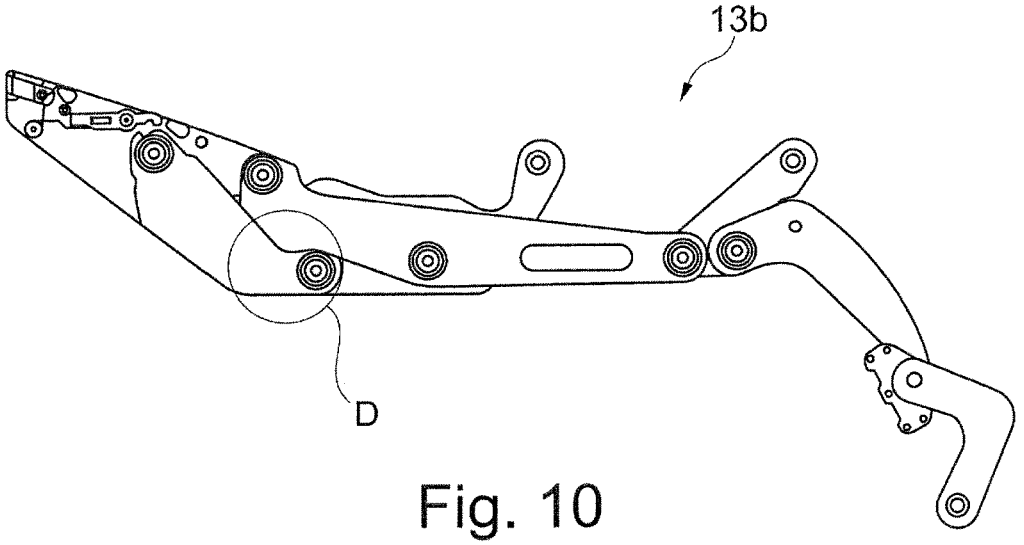
FIG. 10 shows a side view of the guide with a further design of articulated levers, parts of the articulated levers being shown in phantom.
Figure 12:
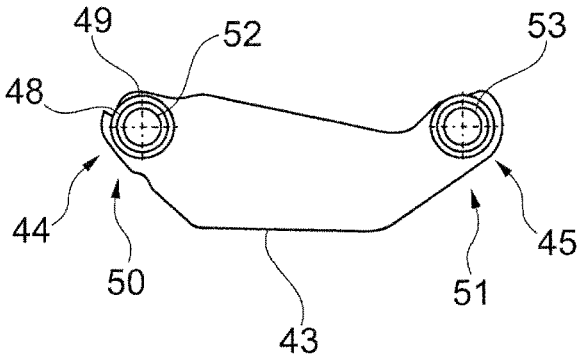
FIG. 12 shows a side view of the articulated lever of the guide according to FIGS. 10 and 11
Figure 11:
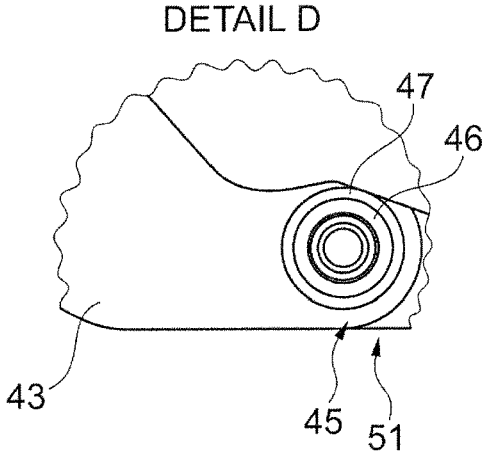
FIG. 11 shows a detail view D of an articulated lever of the guide according to FIG. 10.
Figure 13:
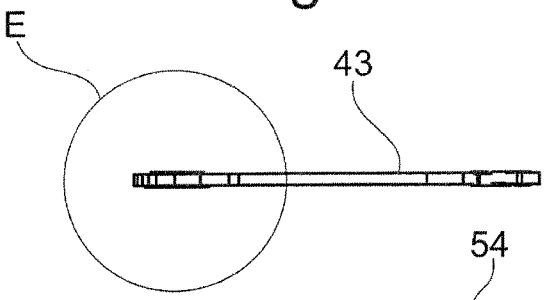
FIG. 13 shows a plan view of the articulated lever according to FIG. 12.
Figure 14:
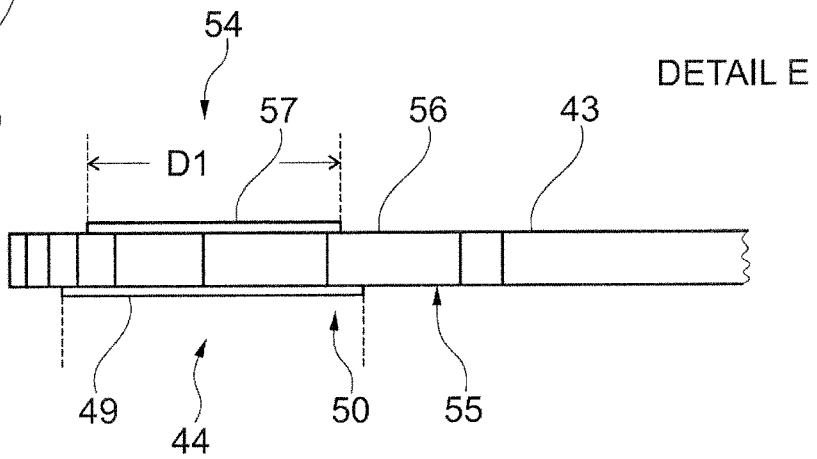
FIG. 14 shows a detail view E of the articulated lever according to FIG. 13.
Figure 15:
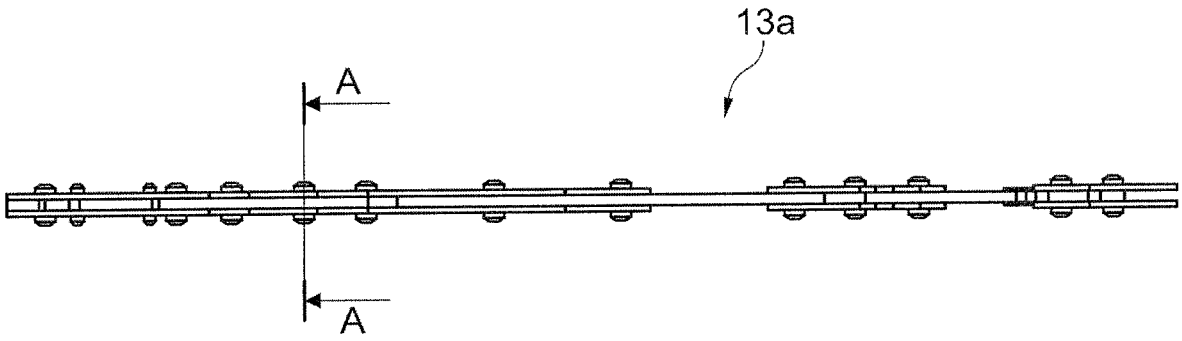
FIG. 15 shows a plan view of the guide in a further design.
Figure 16:
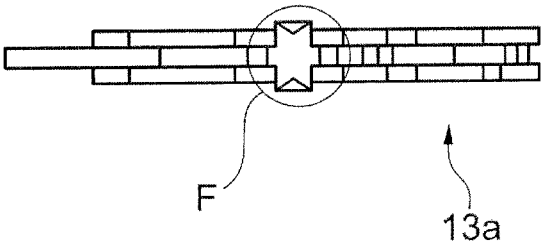
FIG. 16 shows a sectional view of the guide according to FIG. 15.

FIG. 9 illustrates a lever arm 36 of a further articulated lever 37 of the guide 13*a*. The lever arm 36 advantageously comprises three attachment regions 38-40. The articulated levers 18, 37, which particularly have a single lever arm, are advantageously arranged next to one another in one plane in the arranged state on the guide 13*a* (see FIG. 4).

FIGS. 10 to 14 show guide 13*b* with a further variant of embossings. An articulated lever 43 having two attachment regions 44, 45 is shown in FIGS. 10 to 14. The embossings 50, 51 of the attachment regions 44, 45 have circular elevations 47, 49 and depressions 46, 48. As viewed in the radial direction about an opening 52, 53 of an attachment region 44, 45, the elevation and depression of an embossing 50, 51 are designed to extend in an alternating manner. An attachment region 44 advantageously comprises two embossings 50, 54, a first embossing 50 on a first side 55 and a second embossing 54 on a second side 56 of the articulated lever 43 being arranged opposite to one another. In the variant according to FIGS. 10 to 14, an elevation 49 of the first embossing 50 has different circle areas with respect to an elevation 57 of the second embossing 54 of the attachment region 44. For example, an outside diameter D1 of the elevation 57 of the second embossing 54 is identical to an inside diameter of the elevation 49 of the first embossing 50. An outside diameter D2 of the elevation 49 of the first embossing 50 is, for example, greater than the outside diameter D1 of the elevation 57 of the second embossing 54.

The same conversely applies, for example, to the depressions of the embossings 50, 54.

Figure 17:
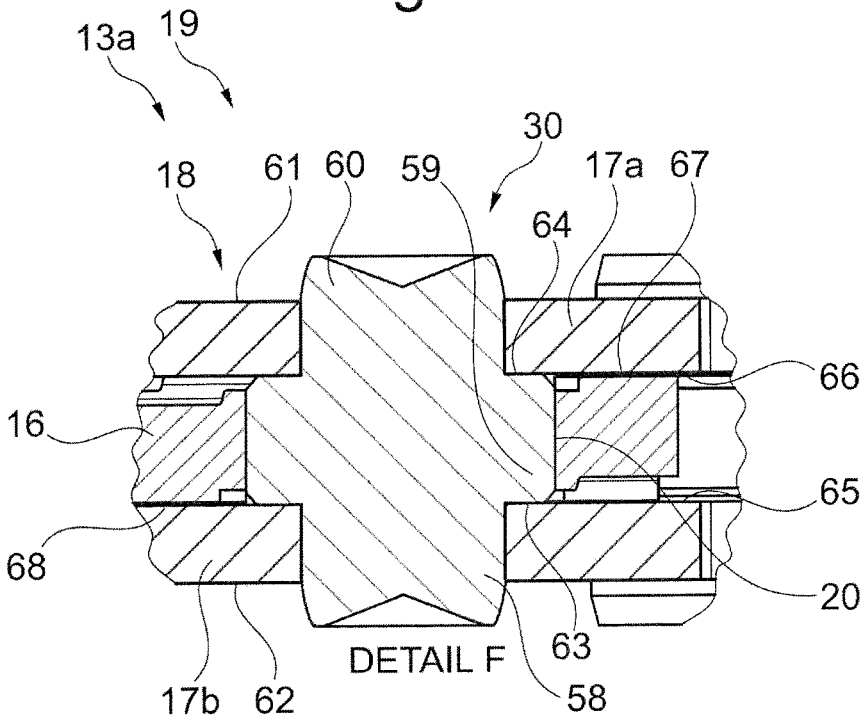
FIG. 17 shows a detail view F of the section according to FIG. 16.

A sectional view through the attachment region 19 of the guide 13*a* is shown in FIG. 17. The articulated lever 16, the lever arms 17*a*, 17*b* of the articulated lever 18 and the rivet member 30 are shown. The rivet member 30 consists of three cylindrical elements 58-60 which are formed in one piece with one another. The central element 59 of the rivet member 30 has a greater outside diameter than the two outer elements 58, 60. The rivet member 30 is advantageously formed in such a way that it can be inserted by the central element 59 into the opening 20 of the articulated lever 16, advantageously with an accurate fit.

End faces of the central element 59 advantageously form bearing surfaces 63, 64 for inner surfaces 65, 66 of the lever arms 17*a*, 17*b* of the articulated lever 18. In the arranged state, the lever arms 17*a*, 17*b* are advantageously mounted so as to be movable on the bearing surfaces 63, 64 of the central element 59. In addition, the inner surfaces 65, 66 of the lever arms 17*a*, 17*b* of the articulated lever 18 are preferably mounted so as to be movable on bearing surfaces 67, 68 of elevations of the embossings 29, 32 of the articulated lever 16 in the arranged state. The elevations of the embossings 29, 32 of the articulated lever 16 advantageously form, with the bearing surfaces 63, 64 of the rivet member 30, bearing planes or support planes for the inner surfaces 65, 66 of the lever arms 17*a*, 17*b* of the articulated lever 18.

In the arranged state, the outer elements 58, 60 advantageously extend beyond an outer surface 61, 62 of the lever arms 17*a*, 17*b*. As a result, the outer elements 58, 60 of the rivet member 30 can, for example, be orbitally formed by means of an orbital riveter, in particular deformed, with the result that, after the orbital forming or deformation, the rivet member 30 interconnects the articulated levers 16, 18 particularly in a movable and nonreleasable manner.

LIST OF REFERENCE SIGNS

1 Wall unit
2 Furniture carcass
3 Upper flap
4 Side wall
5 Side wall
6 Underside
7 Upper side
8 Rear wall
9 Upper flap fitting
10 Fitting unit
11 Fitting unit
12 Base unit
13 Guide
13*a*, 13*b* Guide
14 Pivot arm arrangement
15*a*, 15*b* Mounting plate
16 Articulated lever
17*a*, 17*b* Lever arm
18 Articulated lever
19 Attachment region
20 Opening
21 Side
22-24 Elevation
25-27 Depression
28 Surface
29 Embossing
30 Rivet member
31 Attachment region
33 Side
32 Embossing
34 Surface
35 Elevation
36 Lever arm
37 Articulated lever
38-40 Attachment region
41 Surface
42 Surface
43 Articulated lever
44, 45 Attachment region
46, 48 Depression
47, 49 Elevation
50, 51 Embossing
52, 53 Opening
54 Embossing
55, 56 Side
57 Elevation
58-60 Element
61, 62 Surface
63, 64 Bearing surface
65, 66 Surface
67, 68 Bearing surface

The invention claimed is:

1. An articulated lever for a device for moving a furniture part received on a furniture carcass of an item of furniture, wherein the articulated lever has a spacer member in the form of a first and a second embossing, wherein the first embossing is present on a first side of the first articulated lever, and the second embossing is present on a second side of the first articulated lever, wherein the first and the second side of the first articulated lever are present opposite one another and spaced apart from one another, wherein the first and the second embossing are present opposite one another, wherein the first embossing has in the azimuthal and/or radial direction, about a center, an elevation and a depression relative to a remaining surface of the first side, and the second embossing has in the azimuthal and/or radial direction, about a center, an elevation and a depression relative to a remaining surface of the second side.

2. The articulated lever as claimed in claim 1, wherein the first and/or the second embossing comprise or comprises a plurality of elevations and/or a plurality of depressions, and these elevations and depressions are formed in an alternating manner.

3. The articulated lever as claimed in claim 1, wherein the articulated lever further comprises an attachment member in the form of a through-opening which extends starting from the first side of the articulated lever to the opposite second side of the articulated lever, and wherein the first and/or the second embossing are or is formed to extend about the opening.

4. The articulated lever as claimed in claim 1, wherein the articulated lever further comprises two, three or more spacer members which are formed on the articulated lever so as to be spaced apart from one another.

5. The articulated lever as claimed in claim 1, wherein the first embossing and/or the second embossing have or has a bearing surface.

6. The articulated lever as claimed in claim 5, wherein the elevation of the first embossing and/or the elevation of the second embossing have or has the bearing surface.

7. A device for moving a furniture part received on a furniture carcass of an item of furniture, wherein the device comprises a guide, wherein, with the device mounted on the item of furniture, the furniture part can be moved from a closed position relative to the furniture carcass into an open position relative to the furniture carcass and back by way of the guide, wherein, in the closed position, the furniture part assumes a position in which it is moved up to a front side of the furniture carcass, wherein one guide is formed as a first articulated lever, and a further guide is formed as a second articulated lever, wherein the second articulated lever is formed in a sandwich-like manner with at least two lever arms, with the result that the first articulated lever is received so as to be movable between the two lever arms of the second articulated lever, wherein the first and the second articulated lever are articulately connected to one another at an attachment region by an attachment member, wherein the first articulated lever is formed as an articulated lever as claimed in claim 1, and wherein the embossings of the first articulated lever are arranged between the lever arms of the second articulated lever.

8. A device for moving a furniture part received on a furniture carcass of an item of furniture, wherein the device comprises a guide, wherein, with the device mounted on the item of furniture, the furniture part can be moved from a closed position relative to the furniture carcass into an open position relative to the furniture carcass and back by way of the guide, wherein, in the closed position, the furniture part assumes a position in which it is moved up to a front side of the furniture carcass, wherein one guide is formed as a first articulated lever, and a further guide is formed as a second articulated lever, wherein the second articulated lever is formed in a sandwich-like manner with at least two lever arms, with the result that the first articulated lever is received so as to be movable between the two lever arms of the second articulated lever, wherein the first and the second articulated lever are articulately connected to one another at an attachment region by an attachment member, wherein the first articulated lever is formed as an articulated lever as claimed in claim 1, wherein the device comprises a rivet member, wherein the rivet member has a cylinder shape which has a larger diameter in a central region than in a region of a first end of the rivet member and than in a region of a second end of the rivet member.

9. The device as claimed in claim 8, wherein the rivet member is formed as a solid rivet.

10. The device as claimed in claim 7, wherein the rivet member is present in such a way that, in the arranged state of the rivet member on the opening of the first articulated lever, the rivet member engages through the opening and has its central region arranged in the region of the opening, wherein the rivet member extends by the first end beyond the first side of the first articulated lever and by the second end beyond the second side of the first articulated lever, wherein the central region of the rivet member is longer along a cylinder axis of the rivet member than a width of the first articulated lever, wherein the width extends from the remaining surface of the first side to the remaining surface of the second side of the first articulated lever, with the result that an end face of the central region forms a bearing member for the second articulated lever.

11. The device as claimed in claim 7, wherein the rivet member is present in such a way that the central region of the rivet member extends along a cylinder axis of the rivet member in the arranged state from a bearing surface of an elevation of the first embossing to a bearing surface of an elevation of the second embossing.

12. An item of furniture having an articulated lever as claimed in claim 1.

13. An item of furniture having a device as claimed in claim 7.

* * * * *